United States Patent [19]

Yoshida

[11] Patent Number: 4,931,698

[45] Date of Patent: Jun. 5, 1990

[54] ION SOURCE

[75] Inventor: Yoshikazu Yoshida, Sakai, Japan

[73] Assignee: Matsushita Electric Industrial Co., Ltd., Japan

[21] Appl. No.: 336,934

[22] Filed: Apr. 12, 1989

[30] Foreign Application Priority Data

Apr. 12, 1988 [JP] Japan ..... 63-89852

[51] Int. Cl.[5] ..... H01J 27/04

[52] U.S. Cl. ..... 315/111.81; 250/423 R; 250/427; 315/111.41; 315/111.91

[58] Field of Search ..... 315/111.31, 111.41, 315/111.81, 111.91, 39.67, 42; 313/359.1, 362.1, 231.31; 250/423 R, 427

[56] References Cited

U.S. PATENT DOCUMENTS 4,259,145 3/1981 Harper et al. ..... 313/359.1 X
4,344,019 8/1982 Gavin et al. ..... 315/111.81
4,630,566 12/1986 Asmussen et al. ..... 315/111.81 X
4,728,862 3/1988 Kovarik et al. ..... 315/111.81 X
4,800,281 1/1989 Williamson ..... 315/111.81 X

*Primary Examiner*—Eugene R. LaRoche
*Assistant Examiner*—Seung Ham
*Attorney, Agent, or Firm*—Panitch Schwarze Jacobs & Nadel

[57] ABSTRACT

An ion source comprising a discharge chamber that has a gas inlet and an ion exit, two pairs of cathodes that are disposed on the side surfaces of said discharge chamber, two pairs of anodes, each anode being disposed in a space between the adjacent cathodes, and a pair of solenoids that are wrapped around one pair of cathodes so as to be mutually repulsive magnetically, wherein there is no magnetic field in the central axis of the other pair of cathodes around which no solenoids are wrapped.

9 Claims, 4 Drawing Sheets

FIG. 2
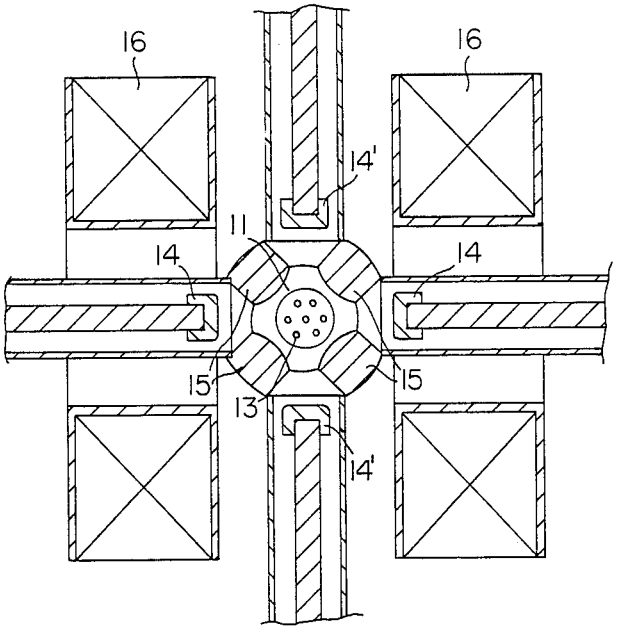
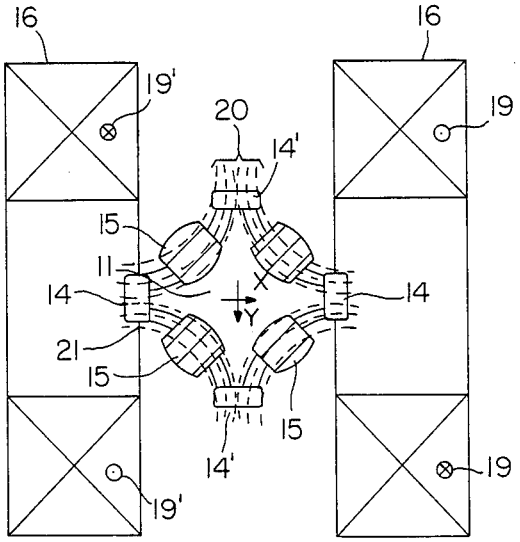
FIG. 3

ION SOURCE

BACKGROUND OF THE INVENTION

1. Field of the Invention

This invention relates to an ion source of the penning ionization gauge (PIG) type that can be used for ion-beam deposition, ion implantation, heavy ion technology, and the like.

2. Description of the Prior Art

As a conventional PIG-type ion source, there is the self-heating type ion source shown in FIG. 5, which was developed by Bennett (Junzo Ishikawa, Ion Source Technology, Ionics, 1986, p. 462). In this ion source, a gas such as argon is supplied into the cylindrical anode 1 via the gas inlet 3. When a magnetic field in the X-direction arising from solenoids 4 and an electric field formed by a power supply 5 in the space between the anode 1 and the cathodes 2 are set at appropriate levels, electrons emitted from the cathodes 2 move by the combination of their cyclotron movement along the magnetic lines of force, their drift movement taking place by means of the orthogonal electromagnetic field, and their oscillatory movement taking place between the two cathodes 2. Then, the electrons collide with neutral particles, so that plasma is produced until the energy of the electrons is almost exhausted. In this way, plasma is produced by a discharge (i.e., an emission of electrons from the cathodes 2) in the above-mentioned PIG-type ion source, and, by an ion-extraction electrode 8 connected to a power supply 7, the ions of the plasma are extracted in a beam form in the Y-direction from the slit-shaped ion exit 6 in the side surface of the anode 1.

In this way, the conventional ion source mentioned above is constructed so that a magnetic field that causes the PIG discharge is applied in the axial direction and ions are extracted through a slit; for this reason, the ion beam extracted through the slit is shaped like a rectangle, which makes it difficult to achieve uniform radiation over a large surface area of samples such as silicon wafers or the like to be treated with ion beams.

SUMMARY OF THE INVENTION

The ion source of this invention, which overcomes the above-discussed and numerous other disadvantages and deficiencies of the prior art, comprises a discharge chamber that has a gas inlet and an ion exit, two pairs of cathodes that are disposed on the side surfaces of said discharge chamber, two pairs of anodes, each anode being disposed in a space between the adjacent cathodes, and a pair of solenoids that are wrapped around one pair of cathodes so as to be mutually repulsive magnetically, wherein there is no magnetic field in the central axis of the other pair of cathodes around which no solenoids are wrapped.

In a preferred embodiment, the central axes of said two pairs of cathodes are perpendicular to each other.

In a preferred embodiment, the solenoids generate a cusp-shaped magnetic field.

In a preferred embodiment, the magnetic field of the center of each solenoid of said pair of solenoids is 0.8 kilogauss.

In a preferred embodiment, a means for radiating microwaves is provided in said discharge chamber.

In a preferred embodiment, the means for radiating microwaves is an antenna.

Another ion source of this invention comprises a discharge chamber that has a gas inlet and an ion exit, two pairs of cathodes that are disposed on the side surfaces of said discharge chamber so that the central axes of said two pairs of cathodes are perpendicular to each other, two pairs of anodes, each anode being disposed in a space between the adjacent cathodes, and a pair of solenoids that are wrapped around one pair of cathodes, so as to be mutually repulsive magnetically and that generates a cusp-shaped magnetic field, wherein there is no magnetic field in the central axis of the other pair of cathodes around which no solenoids are wrapped.

In a preferred embodiment, a means for radiating microwaves is provided in said discharge chamber.

In a preferred embodiment, the means for radiating microwaves is an antenna.

Thus, the invention described herein makes possible the objective of providing an ion source that can achieve uniform radiation over a large surface area of samples to be treated with ion beams.

BRIEF DESCRIPTION OF THE DRAWINGS

This invention may be better understood and its numerous objects and advantages will become apparent to those skilled in the art by reference to the accompanying drawings as follows:

FIG. 2 is a plane view showing the ion source taken along line A—A of FIG. 1.

FIG. 3 is a schematic diagram showing the distribution of an electric field and a magnetic field arising in the ion source shown in FIG. 1.

DESCRIPTION OF THE PREFERRED EMBODIMENTS

Example 1

Figure 1:
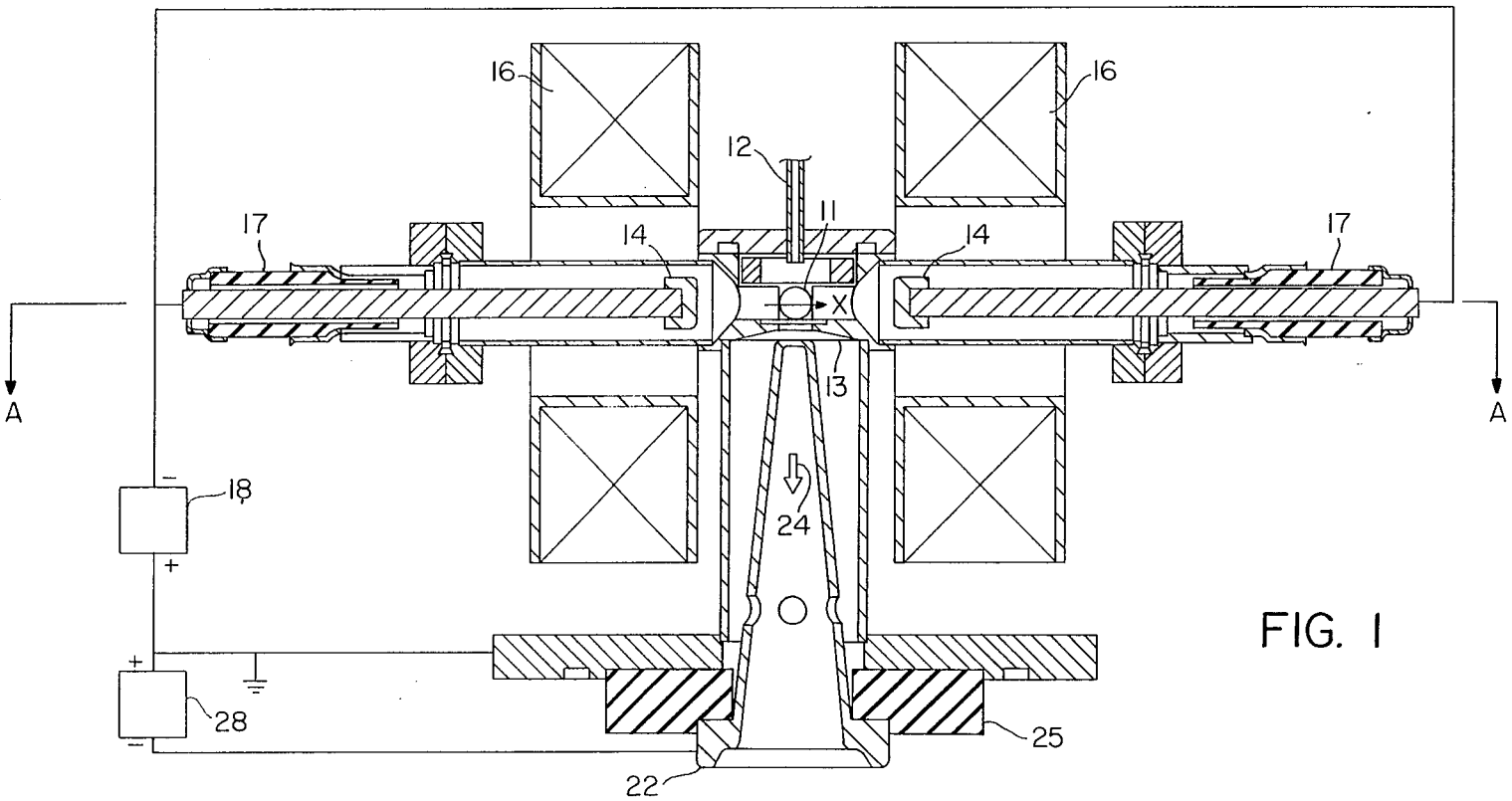
FIG. 1 is a sectional front view showing an ion source of this invention.

FIGS. 1 and 2 show an ion source of this invention, which comprises a discharge chamber 11 that has a gas inlet 12 and an ion exit 13. Two pairs of cylindrical cathodes 14 and 14' are provided in the X-and Y- axis directions, respectively, in a symmetrical manner on all four side surfaces of the discharge chamber 11. Four anodes 15 are disposed between the adjacent cathodes 14 and 14' in a symmetrical manner with respect to two axes that are perpendicular to each other. Each anode 15 has a face that is curved so as to project toward the center of the discharge chamber 11. There are a pair of solenoids 16 that are wrapped around the X-axis of one pair of cylindrical cathodes 14 on the outside of the discharge chamber 11.

Each of the cylindrical cathodes 14 and 14' is insulated electrically from the discharge chamber 11 by means of an insulator 17. A voltage of, for example, −200 V is applied to the cylindrical cathodes 14 by means of a power supply 18. The potential of the anodes is set at the ground level and argon, for example, is introduced into the ion source via the gas inlet 12. Moreover, as shown in FIG. 3, currents 19 and 19' flow through the pair of solenoids 16 so that the solenoids 16 will be mutually repulsive magnetically, and the distribution of a cusp-shaped magnetic field 20 (for example, the distribution of 0.8 kilogauss in the center of each of the solenoids 16) is achieved along the Y-axis of the cylindrical cathodes 14' that have no wrapped solenoids so that the magnetic field will be zero. By means of the cusp-shaped magnetic field 20 and the electric field based on the potential differences between each of the cylindrical cathodes 14 and 14' and the anode 15 adjacent thereto, electrons generated by electrical discharge can be confined within the discharge chamber 11, and the electrons are not diffused onto the wall surfaces of the discharge chamber 11, but collide with neutral particles (e.g., argon atoms). Accordingly, the energy of the electrons can be effectively used to produce high-density plasma until the energy is almost exhausted. That is, the cusp-shaped magnetic field 20 forms a magnetic field in the direction parallel to each surface of the anodes 15, so that the movement of electrons across the magnetic field 20 can be limited. Thus, the electrons are not absorbed by the wall surfaces of the anodes 15, resulting in an increase in the length of the flight path of the electrons. Although the wall surfaces of the cylindrical cathodes 14 and 14' that are perpendicular to the magnetic field 20 can absorb the electrons thereon, by the electric field 21, the cylindrical cathodes 14 and 14' repulse the electrons. When both the magnetic field 20 and the electric field 21 are used at the same time, the electrons can be confined within the discharge chamber 11 without the diffusion of the electrons onto the wall surfaces of the discharge chamber 11, so that high-density plasma can be produced in the discharge chamber 11. When there are a number of pores (e.g., 7 pores each with an inner diameter of 2 mm) in the ion exit 13, and a voltage of −10 kV is applied to the ion-extraction electrode 22 by means of a power supply 23, it is possible to obtain a cylindrical-shaped ion beam 24 of argon ion from the plasma in the discharge chamber 11. At least the interior and exterior walls of the discharge chamber 11 are constructed by a non-magnetic material so that the magnetic field and the electric field inside of the discharge chamber 11 are not affected by the external magnetic field or the like of the discharge chamber 11. Reference numeral 25 is an insulator.

Example 2

Figure 4:
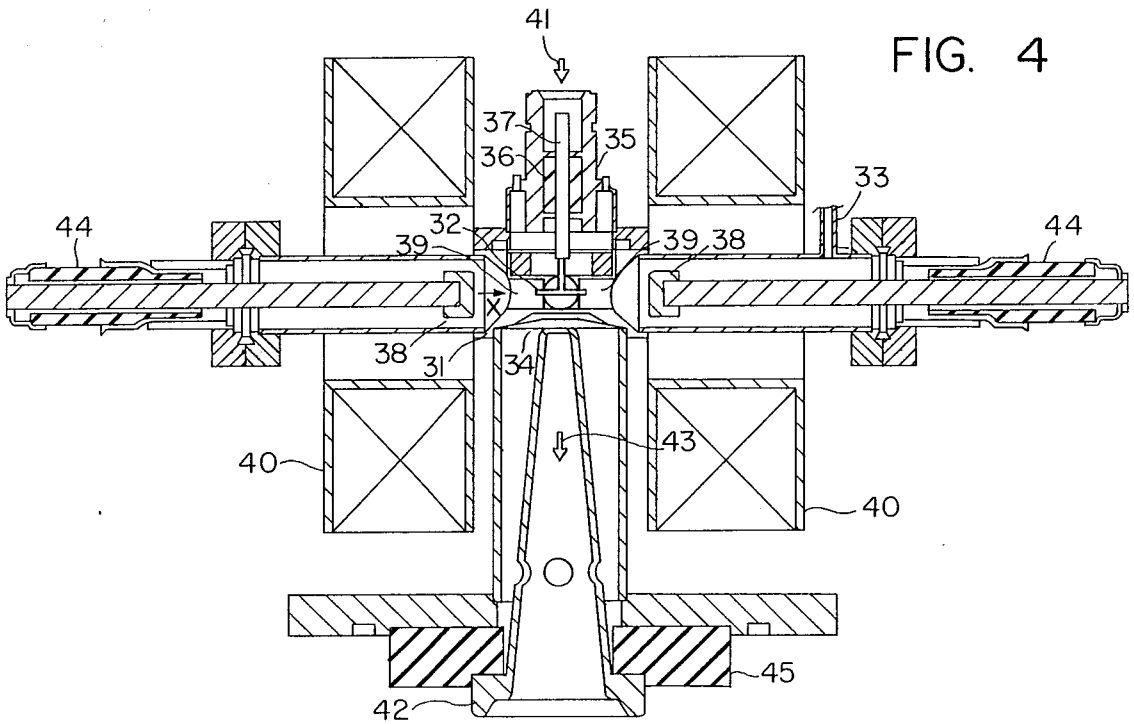
FIG. 4 is a sectional front view showing another ion source of this invention.
Figure 5:
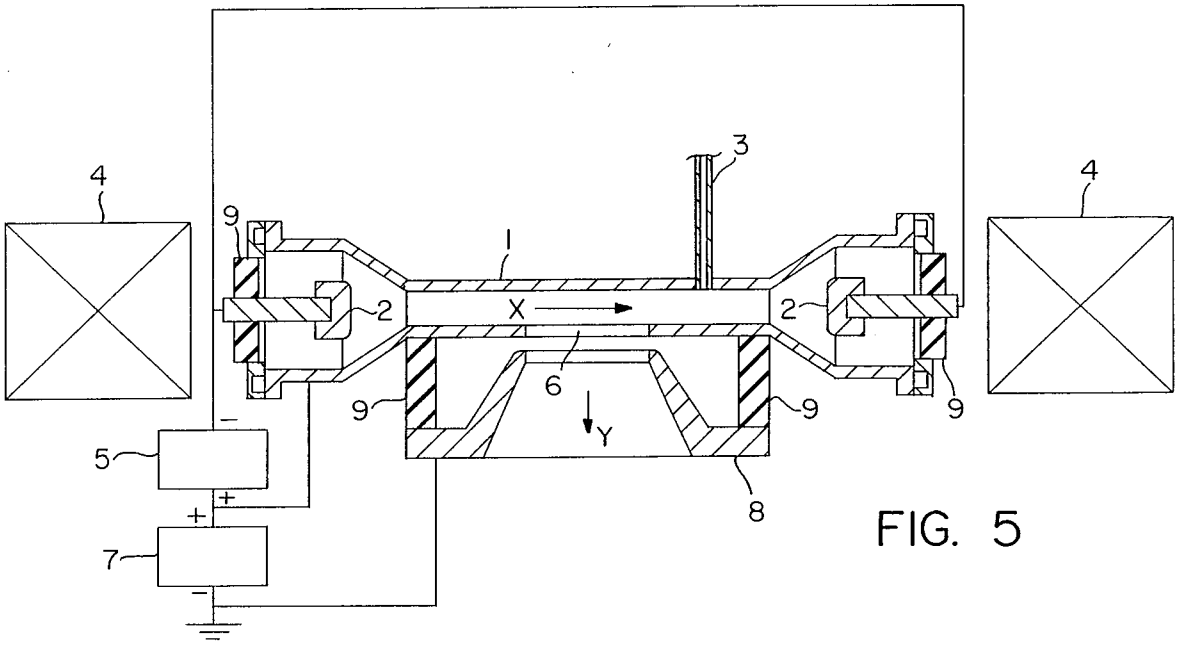
FIG. 5 is a sectional front view showing a conventional ion source.

FIG. 4 shows another ion source of this invention, which is different from the ion source of Example 1 in that the ion source of this example has a ring-shaped antenna 32 in the center of the discharge chamber 31. The antenna 32 functions to radiate microwaves.

The discharge chamber 31 has a gas inlet 33 and an ion exit 34. A connector 35 for introducing microwaves into the discharge chamber 31 therethrough is disposed in the discharge chamber 31 so as to face the ion exit 34. The connector 35 supports a shaft 37 on the same axis as that of the connector 35 by means of an insulator 36. The shaft 37 is connected with the ring-shaped antenna 32 positioned in the central part of the discharge chamber 31. There are four cylindrical cathodes 38 on all four of the side surfaces of the discharge chamber 31 in the same way as those of Example 1. There are also provided four anodes 39 between the adjacent cathodes 38 in a symmetrical manner with respect to two axes that are perpendicular to each other in the same way as those of Example 1. Each anode 39 has a face that is curved so as to project toward the center of the discharge chamber 31. Moreover, there are a pair of solenoids 40 that are wrapped around the X-axis of one pair of cylindrical cathodes 38 on the outside of the discharge chamber 31, as well.

When reactive gases such as oxygen are supplied to the discharge chamber 31 via the gas inlet 33, a PIG discharge that arises from the electric field formed by the cylindrical cathodes 38 and the anodes 39 and the cusp-shaped magnetic field formed by the solenoids 40 brings about the production of plasma in the discharge chamber 31. The cylindrical cathodes 38 function as a source of supply of electrons for use in the maintenance of the electrical discharge, but the supply of electrons becomes unstable when the surfaces of the cathodes 38 are oxidized with oxygen plasma, resulting in unstable electrical discharge. At this time, microwaves 41 are supplied to the discharge chamber 31 via the connector 35 by means of the antenna 32, even if the supply of electrons from the cylindrical cathodes 38 becomes unstable, because the electrons in the plasma obtain energy from the microwaves, so the energy of the electrons that is required to bring about the desired stable discharge can be supplied in sufficient amounts. The resulting stable plasma is extracted from the ion exit 34 to form a cylindrical-shaped ion beam 43. The reference numerals 44 and 45 of FIG. 4 are insulators.

Although a reactive gas was used in this example as the gas supplied to the discharge chamber 31 via the gas inlet 33, this invention is, of course, applicable to a rare gas that attains the same effect as described above.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An ion source comprising a discharge chamber that has a gas inlet and an ion exit, two pairs of cathodes that are disposed on the side surfaces of said discharge chamber, two pairs of anodes, each anode being disposed in a space between the adjacent cathodes, and a pair of solenoids that are wrapped around one pair of cathodes so as to be mutually repulsive magnetically, wherein there is no magnetic field in the central axis of the other pair of cathodes around which no solenoids are wrapped.

2. An ion source according to claim 1, wherein the central axes of said two pairs of cathodes are perpendicular to each other.

3. An ion source according to claim 1, wherein said solenoids generates a cusp-shaped magnetic field.

4. An ion source according to claim 1, wherein the magnetic field of the center of each solenoid of said pair of solenoids is 0.8 kilogauss.

5. An ion source according to claim 1, wherein a means for radiating microwaves is provided in said discharge chamber.

6. An ion source according to claim 5, wherein said means for radiating microwaves is an antenna.

7. An ion source comprising a discharge chamber that has a gas inlet and an ion exit, two pairs of cathodes that are disposed on the side surfaces of said discharge chamber so that the central axes of said two pairs of cathodes are perpendicular to each other, two pairs of anodes, each anode being disposed in a space between the adjacent cathodes, and a pair of solenoids that are wrapped around one pair of cathodes so as to be mutually repulsive magnetically and that generates a cusp-shaped magnetic field, wherein there is no magnetic field in the central axis of the other pair of cathodes around which no solenoids are wrapped.

8. An ion source according to claim 7, wherein a means for radiating microwaves is provided in said discharge chamber.

9. An ion source according to claim 8, wherein said means for radiating microwaves is an antenna.

* * * * *